US006428681B1

(12) United States Patent
Lorincz

(10) Patent No.: US 6,428,681 B1
(45) Date of Patent: Aug. 6, 2002

(54) SYSTEM AND METHOD FOR REVERSING ELECTROLYTE FLOW DURING AN ELECTROPOLISHING OPERATION

(75) Inventor: Thomas A. Lorincz, Hollister, CA (US)

(73) Assignee: Therma Corporation, Inc., San Jose, CA (US)

( * ) Notice: Subject to any disclaimer, the term of this patent is extended or adjusted under 35 U.S.C. 154(b) by 48 days.

(21) Appl. No.: 09/732,231

(22) Filed: Dec. 6, 2000

(51) Int. Cl.[7] ..... C23F 3/00

(52) U.S. Cl. ..... 205/645; 205/672; 205/686; 204/225; 204/228.8; 204/275.1; 234/69

(58) Field of Search ..... 205/345, 672, 205/686; 204/225, 228.8, 275.1; 234/69

(56) References Cited

U.S. PATENT DOCUMENTS

| | | | | |
|---|---|---|---|---|
| 2,764,540 A | | 9/1956 | Farin et al. | 204/140.5 |
| 3,055,812 A | | 9/1962 | Andersson | 204/140.5 |
| 3,202,598 A | | 8/1965 | Covington et al. | 204/224 |
| 3,329,596 A | | 7/1967 | Abt et al. | 204/143 |
| 4,167,462 A | * | 9/1979 | Schrader et al. | 204/228.8 |
| 4,369,101 A | | 1/1983 | Wolff et al. | 204/224 R |
| 4,645,581 A | | 2/1987 | Voggenthaler et al. | 204/275 |
| 4,705,611 A | | 11/1987 | Grimes et al. | 204/129.1 |
| 4,772,367 A | | 9/1988 | Menzel et al. | 204/129.5 |
| 4,826,582 A | | 5/1989 | Lavalerie et al. | 204/196 |
| 5,135,625 A | | 8/1992 | Lewy | 204/129.6 |
| 5,507,923 A | | 4/1996 | Stouse et al. | 205/679 |
| 5,958,195 A | | 9/1999 | Lorincz et al. | 204/224 M |
| 6,217,726 B1 | | 4/2001 | Lorincz et al. | 204/224 M |
| 6,277,264 B1 | | 8/2001 | Lorincz | 205/679 |

* cited by examiner

*Primary Examiner*—Arun S. Phasge
(74) *Attorney, Agent, or Firm*—Henneman & Saunders; Larry E. Henneman, Jr.

(57) ABSTRACT

A pipe electrochemical polishing system (10, 10*a*) for in place polishing of a pipe (28(has provision for detecting the instant position of a cathode (14) within the pipe (28) such as cable marks (52) and cable mark sensor (50), an infrared camera (60), heat sensing crayon marks (64), thermisters (66), and capacitance sensors (68), used individually or in combination. According to the inventive in place electropolishing method (80) when it is determined that the cathode is in a non horizontal portion (72) of the pipe (28) and further is presently traveling generally downward, then the direction of flow of the electrolyte (24) is reversed to carry any bubbles in the electrolyte (24) away from the area of the cathode (14).

32 Claims, 3 Drawing Sheets

Controller
Power Supply
Cable Rinse

SYSTEM AND METHOD FOR REVERSING ELECTROLYTE FLOW DURING AN ELECTROPOLISHING OPERATION

TECHNICAL FIELD

The present invention relates to the field of electrochemical processing, and more particularly to an apparatus and method for improving electropolishing action by keeping gas bubbles, which can interfere with such polishing, away from a polishing electrode. The predominant current usage of the present inventive apparatus and method for improved electropolishing is in the in place polishing of pipes used in processing facilities.

BACKGROUND ART

It is known in the art to deposit and/or remove materials by passing an electric current through a fluid electrolyte which is in contact with a conductive electrode. Materials are exchanged between the electrolyte and the electrode depending upon the direction of current flow and the ionization of materials to be deposited on or removed from the electrode. Electroplating is a well known application of this general method. Electropolishing is also well known in the art. In the electropolishing process, irregularities and deposits on a surface are removed by causing such to be drawn into the electrolyte solution.

An example is the in place electrochemical polishing of a pipe. In such an example, a cathode is drawn through the pipe while an electrolyte solution is simultaneously pumped through the pipe. The pipe acts as an anode and is electrochemically polished in the process. Since the electrolyte solution must be continuously pumped through the pipe during the process, it is most practical to recirculate the solution.

In the prior art it has been customary to circulate the electrolyte solution through the pipe in a direction opposite to that in which the cathode is drawn through the pipe. Although it may not have been the primary intended advantage of this direction of flow, at least an incidental advantage is that such an arrangement tends to cause any bubbles formed at the cathode to be carried back to that part of the pipe which has already been polished. Such bubbles, when present in the area of the electrode, tend to prevent the electrolyte from coming into direct contact with the pipe and, therefore, interfere with the polishing process. A dam adapted to facilitate the flow of such bubbles away from the polishing area has been used successfully by the present inventor. However, this solution has not been entirely successful where the electrode is moving through generally vertical, or at least non-horizontal, sections of the pipe, wherein the bubbles tend to float upward toward the electrode.

It would be advantageous to have additional methods and/or means for moving gas bubbles away from the electrode during an in place pipe electropolishing operation.

Such methods and/or means would be useful by themselves and/or in combination with existing methods and means.

SUMMARY

Accordingly, it is an object of the present invention to provide an apparatus and method for improving the polishing action of a pipe inner surface electropolishing system.

It is still another object of the present invention to provide an apparatus and method for moving bubbles away from the polishing area in a pipe electropolishing system.

It is yet another object of the present invention to provide an apparatus and method for removing bubbles from the cathode area in a pipe inner surface polishing system which can be used in conjunction with existing methods and apparatus.

It is still another object of the present invention to provide an apparatus and method for removing bubbles from the cathode area in a pipe inner surface polishing system which can be easily and inexpensively added to existing pipe electropolishing devices.

Briefly, a known embodiment of the present invention is an improved in place electropolishing apparatus for polishing the inner surface of a pipe. According to one described embodiment of the present invention, a cathode is drawn through a pipe while an electrolyte solution is moved through the pipe in a direction generally opposite to the direction of travel of the cathode. However, when the cathode is moving generally upward through a vertical or inclined portion of the pipe, the direction of flow of the electrolyte is reversed such that the electrolyte also flows upward in the pipe, thereby carrying bubbles, which would otherwise tend to be trapped in the electropolishing area, away from the cathode.

According to one embodiment of the present invention, it is desirable to know where within a pipe the electrode is at any given time during the processing process. This can be accomplished in a number of ways, including but not limited to methods and means specifically discussed herein. For example, the cable which pulls the cathode through the pipe could be encoded (e.g., with colored or magnetic markings, or the like) such that the position of the cathode can be generally determined by keeping track of how much cable has been pulled through. Another means would be to measure the resistance and/or capacitance between the cathode and a measuring electrode placed at the end of the pipe and/or at various points along the pipe. Other means for detecting the position of the cathode could rely upon the fact that there is a significant amount of heat generated at the location of the cathode during the electropolishing process. This heat can be detected by an infrared camera, by thermisters placed at specified locations along the pipe, or by marking the pipe at various locations and/or intervals with a heat sensitive crayon that changes color or melts when heated by the cathode.

An advantage of the present invention is that polishing is improved in at least some non-vertical sections of a pipe.

Another advantage of the present invention is that gas bubbles are removed away from the area of the cathode in an in place pipe polishing system.

A further advantage of the invention is that it can be used in conjunction with known methods and/or apparatus for moving the bubbles away from the electrode in an in place pipe electropolishing system.

Still another advantage of the invention is that existing in place pipe electropolishing devices can be easily and inexpensively modified to incorporate the inventive method and apparatus.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed objects and/or advantages are not considered to be essential elements of the present invention, and should not be construed as limitations.

DETAILED DESCRIPTION

Figures 1, 2:
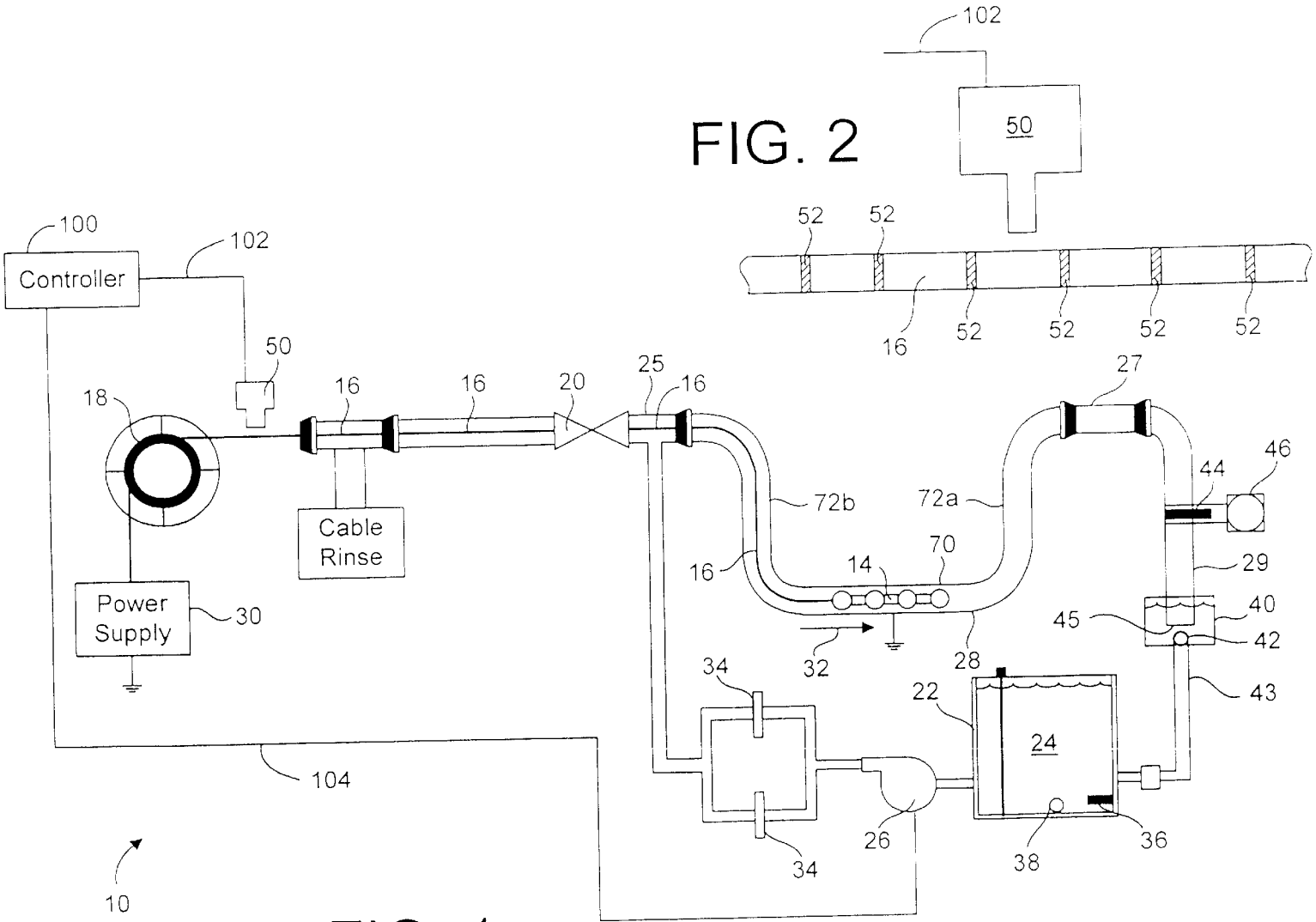
FIG. 1 is block diagrammatic view of a particular embodiment of an in place pipe electropolishing system according to the present invention.
FIG. 2 is a more detailed view of a portion of the cable and cable mark detector of FIG. 1.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

Unless otherwise stated herein, component parts of the invention will be familiar to one skilled in the art, and may be purchased or readily manufactured accordingly. Also, unless otherwise stated herein, substitutions can be made for the components described, and each of the individual components, except as specifically claimed, is not an essential element of the invention.

A known mode for carrying out the invention is an in place pipe electrochemical polishing system 10. The in place pipe electrochemical polishing system 10 is depicted in a block schematic diagrammatic view in FIG. 1. As one skilled in the art will recognize, some of the relevant component parts of the in place pipe electrochemical polishing system are a cathode 14, a cathode puller cable 16, a cable puller 18, a valve 20, an electrolyte reservoir 22 for containing a supply of an electrolyte 24, and an electrolyte pump 26, all of which are provided for the purpose of polishing the inner surface of a pipe 28. One end of pipe 28 is coupled to system 10 by an adapter 25, and the other end of pipe 28 is coupled to an end pipe 29 of system 10 by another adapter 27. In the electrochemical polishing process, the cathode 14 is drawn toward the cable puller 18 by the cathode puller cable 16, while electrical current is supplied, via cable 16, to cathode 14 from a power supply 30. The current flows through the electrolyte 24 in the pipe 28, which shares a common ground with the power supply 30 such that the pipe 28 acts as an anode and the inner surface thereof is polished, according to the known principles of electropolishing. During the process, the electrolyte 24 is generally pumped to flow through the pipe 28 in a direction opposite that in which the cathode 14 is being drawn, as indicated by directional arrow 32. The valve 20 prevents the electrolyte 24 from escaping the pipe 28 while allowing the cathode puller cable 16 to be pulled therethrough.

In the particular example of the in place polishing system 10 shown in the view of FIG. 1, two filters 34 are placed in the path of the electrolyte to insure that particulate matter removed from the inside of the pipe 28 is removed from the electrolyte 24 solution as it is recirculated through the in place polishing system 10 by the electrolyte pump 26. An electric heater 36 and a temperature indicating control 38 are also provided in the path of the electrolyte 24. In this example, the electric heater 36 and the temperature indicating control 38 are located in the electrolyte reservoir 22. Also, in the present example of the invention, a collector sump 40 catches the electrolyte 24 as it flows out of end pipe 29. A collector sump pump 42 disposed in sump 40 pumps the electrolyte 24 from the collector sump 40 to the electrolyte reservoir 22, via a return line 43. A heat exchanger 44 is provided in the path of the electrolyte 24 with a chiller 46 operatively connected thereto. The chiller 46 is a conventional refrigeration unit and pump, and the heat exchanger 44 is adapted to transfer heat from the electrolyte 24 in end pipe 29 to the chiller 46.

In the embodiment of the invention shown in FIG. 1, the pump 26 is a reversible pump. One skilled in the art will recognize that in order for pump 26 to be able to reverse the flow of electrolyte 24 through pipe 28, collector sump 40 and reservoir 22 must be sealed. Further, sump pump 42 must be set to maintain the level of electrolyte 24 in sump 40 above the open end 45 of end pipe 29, to avoid introducing air into end pipe 29 when flow is reversed. Additionally, sump pump 42 must allow the reverse flow of electrolyte 24 from return line 43 back into sump 40. Other related modifications might optionally be made according to the particular application, as will be discussed in more detail hereinafter.

Further, in the embodiment of the invention shown in the view of FIG. 1, the cathode puller cable 16 is marked such that a cable mark sensor 50 can sense how far the cable has been pulled and generate a corresponding position signal. A controller 100 receives the position signal from sensor 50 via a signal line 102, and provides a flow direction signal, via signal line 104, to pump 26 depending on the position of cathode 14. Additionally, the contour of pipe 28 is provided to controller 100 by a system operator (not shown). When controller 100 determines from the position signal and the contour of pipe 28 that cathode 14 is traveling downward through a first non-horizontal portion 72*a* of pipe 28, controller asserts a first flow direction signal on signal line 104 that causes pump 26 to maintain the flow of electrolyte 24 in the normal direction indicated by directional arrow 32. Similarly, when controller 100 determines that cathode 14 is in a horizontal portion 70 of pipe 28, controller 100 asserts the first flow direction signal on signal line 104, causing pump 26 to maintain the flow of electrolyte 24 in the normal direction. However, when controller 100 determines that cathode 14 is traveling upward through a second non-horizontal portion 72*b* of pipe 28, controller 100 asserts a second flow direction signal on signal line 104, causing pump 26 to reverse the flow of electrolyte 24 through pipe 28, such that electrolyte 24 flows in the direction opposite to directional arrow 32.

Those skilled in the art will recognize, that the above-described function of controller 100 may be performed manually, but perhaps not as efficiently, by a system operator. Therefore, an automated controller such as controller 100 is not considered to be an essential element of the present invention. FIG. 2 is a more detailed view of the cable mark sensor 50 and a portion of the cable 16 showing a plurality of cable marks 52 on the cable. In the embodiment shown in the view of FIG. 2, the cable mark sensor 50 is a optical sensor and the cable marks 52 are relatively (as compared to the color of the cable 16) dark bands about the cable 16. However, it is within the scope of the sensor that essentially any means, known or yet to be developed, could be used to sense how much of the cable has been pulled past the cable mark sensor 50. For example, the cable marks 52 could be magnetic bands and the cable mark sensor 50 could be a magnetic sensor. Optionally, cable mark sensor 50 could be replaced by, for example, measuring the amount of cable drawn through system 10 by monitoring the revolutions of cable puller 18.

Figure 3:
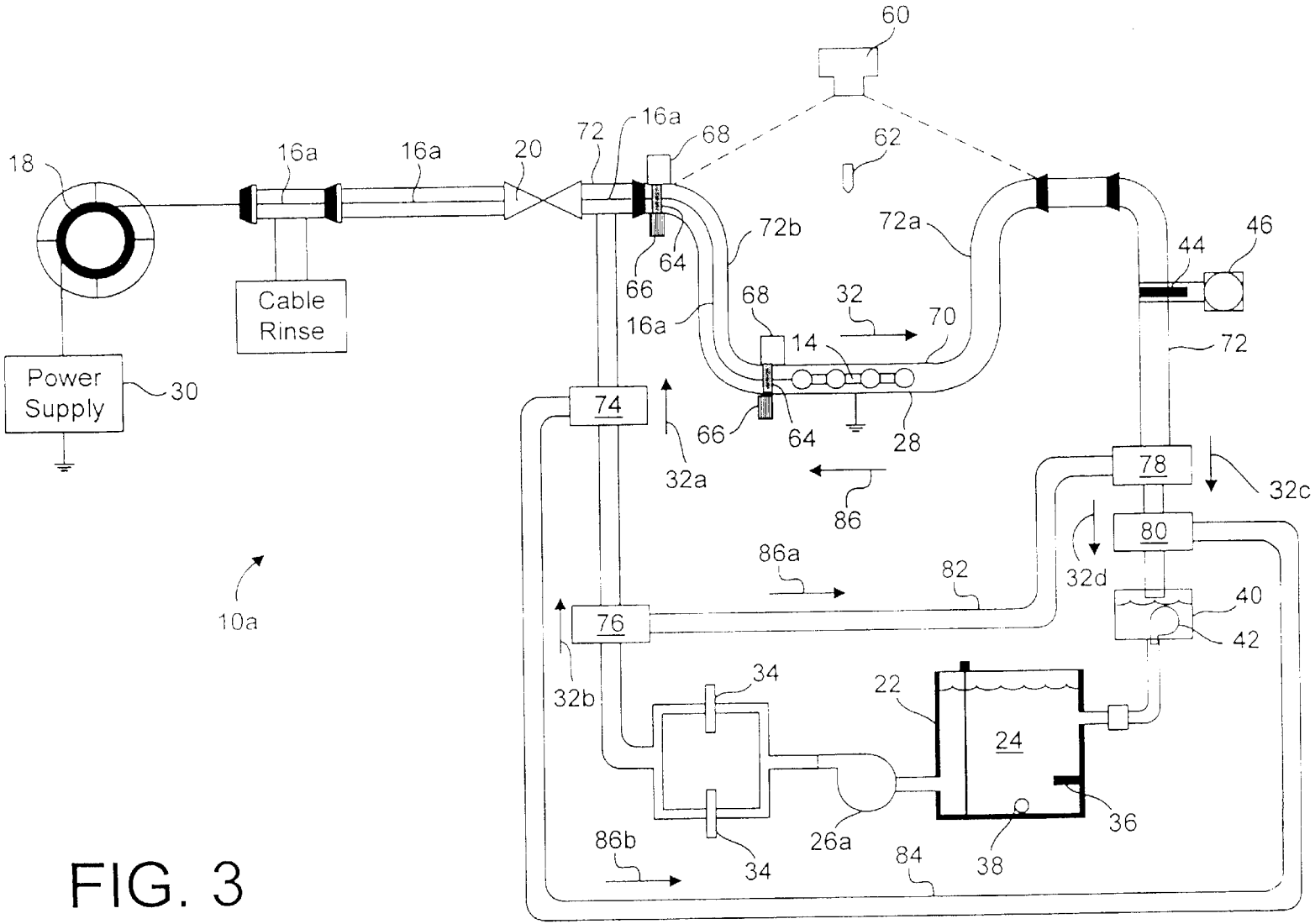
FIG. 3 is a block diagrammatic view of another particular embodiment of an in place pipe electropolishing system according to the present invention.

FIG. 3 is an alternative in place polishing system 10*a*, in which components are alike to and numbered the same as those of the example of FIG. 1, except for those specifically discussed herein as being different. In the alternative in place polishing system 10*a*, a standard cable 16*a* is a plain, unmarked cable, such as has been used in the prior art, and the pump 26*a* is a conventional unidirectional pump, such as has been used in the prior art.

Visible in the view of FIG. 3 are an infra red camera 60, a heat sensing crayon 62 and a plurality (two are shown) of heat sensing crayon marks 64 on the pipe 28. A plurality (two are shown) of thermisters 66 are also shown placed on the pipe 28 in the view of FIG. 3. A plurality (two are shown) of capacitance sensors are also shown on the pipe 28 in the view of FIG. 3.

As was briefly discussed hereinbefore, the practice of the present invention requires some knowledge of the present location of the cathode 14 during the polishing process. Since the cathode 14 gives off a substantial amount of heat during the electropolishing process, the infra red camera 60 can be used to detect the instant location of the cathode 14. Similarly, the heat sensing marks 64 made by the heat sensing crayon 62 will change color when the cathode 14 is passing within the pipe 18 under the marks 64, thereby disclosing the location of the cathode 14. In like manner, the thermisters 66 will detect a rise in heat when the cathode 14 is passing within the pipe 28 at the location of the thermisters 66. Also, when the cathode 14 passes through a particular location in the pipe 28, the capacitance across the pipe will be reduced, and this can be detected by one of the capacitance sensors 68 placed at such location.

It should be noted that, in actual practice, more than two cathode position sensors (e.g., thermisters 66, capacitance sensors 68, heat sensing crayon marks 64, or the like) will be used, depending on the configuration of pipe 28. In particular, position sensors would be placed along pipe 28 at each point where cathode 14 begins or completes an upward traverse of an non-horizontal portion of pipe 28. These points correspond to cathode positions where it may be desirable to change the direction of electrolyte 24 flow through pipe 28.

Also seen in the view of FIG. 3 are a first valve 74, a second valve 76, a third valve 78, a fourth valve 80, a first crossover pipe 82 and a second crossover pipe 84. The four valves 74, 76, 78 and 80 are each diversion valves which selectively route a single input to either one of two outputs. As previously discussed herein, in normal operation the pump 26*a* pumps the electrolyte 24 through the pipe 28 in the direction indicated by the directional arrow 32, and also as indicated by directional arrows 32*a*, 32*b*, 32*c* and 32*d* in the view of FIG. 3. In such an operational mode, the valves 74, 76 78 and 80 are all positioned such that the flow of the electrolyte 24 through the pipe 28 is essentially the same as in the prior art, as illustrated in the view of FIG. 1. In this mode there is no flow of electrolyte through either of the cross over pipes 82 and 84.

In order to reverse the direction of flow of the electrolyte 24 through the pipe 28, the valves 74, 76, 78 and 80 are all switched over such that the electrolyte 24 flows through the first crossover pipe 82 in a direction indicated by a directional arrow 86*a*, and further such that the electrolyte 24 flows through the second crossover pipe 84 in a direction indicated by a directional arrow 86*b*. This results in the flow of electrolyte within the pipe 28 being in a direction indicated by a directional arrow 86.

In operation, when the cathode 14 is pulled through a horizontal portion 70 of the pipe, the flow of electrolyte 24 will be in the direction indicated by the directional arrow 32 which, as discussed above, is opposite to the direction of travel of the cathode 14.

Similarly, when the cathode 14 is traveling generally downward, through a nonhorizontal portion 72*a* in the example of FIG. 3, then the flow of electrolyte 24 will also be in the direction indicated by the directional arrow 32. However, when the cathode 14 is traveling generally upward, as it would be through non-horizontal portion 72*b* of FIG. 3, then the direction of the flow of the electrolyte 24 will be reversed, as indicated by the directional arrow 86. This direction of flow will carry any bubbles in the electrolyte 24 away from the cathode 14. Such bubbles would otherwise try to move upward and would be trapped in the area of the cathode 14. This would prevent the electrolyte 24 from making good contact on the pipe 28, and would adversely effect the polishing action in such section of the pipe 28.

Regarding the several means available for detecting the position of the electrode 14 in the pipe 28: If used, the infrared camera 60 could be moved, as necessary during the course of the polishing process, such that those portions of the pipe 28 wherein the cathode 14 is currently located could be seen by the infra red camera 60. It should be noted that the practice of the present inventive method is not limited to the use of any one method for detecting the position of the cathode 14. Any of the thermisters 66, capacitance sensors 68, heat sensing crayon marks 64, or infrared camera 60, or any combination thereof could be used to detect the current position of the cathode 14 during a single electropolishing process. Also, any of these could be used in combination with the cable marks 52 and cable mark sensor 50, previously discussed herein in relation to FIGS. 1 and 2, or could be substituted for or used in combination with other methods and/or means for detecting the present position of the cathode 14.

Controller 100 is not shown in FIG. 3, so as not to unnecessarily obscure the other features of system 10*a*. Those skilled in the art will understand, however, that system 10*a* may be implemented automatically with controller 100, or manually by an operator (also not shown). In fact, certain of the disclosed position sensors (e.g., infra red camera 60 crayon marks 60) are well suited for use with a manual system. The other disclosed position sensors (e.g., thermisters 66 and capacitative sensors 68) generate electrical signals that can be interpreted by controller 100, and are therefore well suited for an automatic system. In such an automated system, controller 100 receives position signals from the sensors via signal lines (not shown), and, responsive to the position signals, controls valves 74, 76, 78, and 80 via control lines (not shown).

Figure 4:
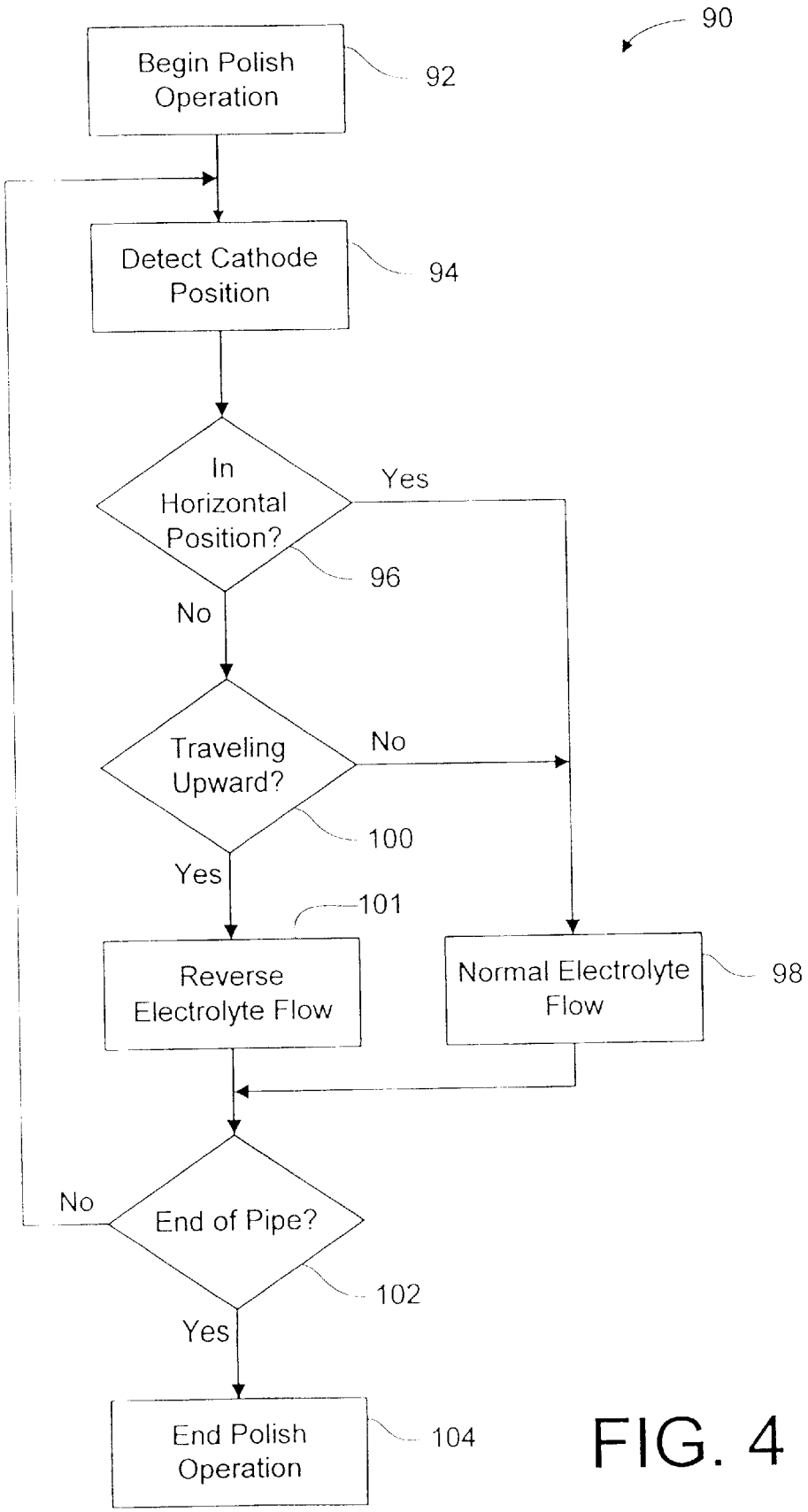
FIG. 4 is a flow chart summarizing one particular method for electropolishing the inner surface of a pipe according to the present invention.

FIG. 4 is a flow chart summarizing one particular in place electropolishing method 90, according to the present invention. In a begin polish operation 92 voltage is applied to the cathode 14 by the power supply 30 (FIGS. 1 and 3), and the cable puller 18 (FIG. 1) or cable puller 18*a* (FIG. 3) begins to pull the cathode 14 through the pipe 28 by the cathode puller cable 16 (FIG. 1) or 16*a* (FIG. 3). The begin polish operation 92 is conventional in nature and is not unlike such operation as applied in the prior art.

One skilled in the art will recognize in the diagram of FIG. 4 that a detect cathode position operation 94 begins an operational loop that is repeated during the continuation of the in place electropolishing method 90. In a detect cathode position operation 94, the position of the cathode 14 (FIGS. 1 and 3) is detected, such as by use of the calibrated cathode puller cable 16 having thereon cable marks 52 and the cable marks sensor as discussed in relation to FIG. 1. Alternatively, any other method, such as the heat detecting methods using the infra red camera 60 (FIG. 3), the heat sensing crayon marks 64, the thermisters, or the like and/or any combination thereof could be used. Another alternative for accomplishing the detect cathode position operation 84 could be the use of the capacitance sensors 68 as discussed previously herein in relation to FIG. 3, or essentially any other means for detecting the position of the cathode 14, now known or yet to be developed.

Next, in an in horizontal portion decision operation 96 it is determined if the cathode 14 is in a generally horizontal portion 70 of the pipe 28. If the cathode 14 is in a horizontal portion of the pipe 28, then the in place electropolishing method 90 proceeds to a normal electrolyte flow operation 98 wherein the electrolyte 24 (FIGS. 1 and 3) is started or allowed to continue to flow in the "normal" direction as indicated by the directional arrow 32. If it is determined in the in horizontal portion decision operation 96 that the cathode 14 is not in a horizontal portion 70 of the pipe, then operation of the in place electropolishing method 90 proceeds to a traveling upward decision operation 100 wherein it is determined if the cathode 14 is presently traveling in a generally upward direction. If the cathode 14 is not traveling in a generally upward direction, then the in place electropolishing method 90 proceeds to the normal electrolyte flow operation 98 wherein the electrolyte 24 (FIGS. 1 and 3) is started or allowed to continue to flow in the "normal" direction as indicated by the directional arrow 32. If it is determined in traveling upward decision operation 100 that the electrode 14 is presently traveling in a generally upward direction, then method 90 proceeds to a reverse electrolyte flow operation 101.

In the reverse electrolyte flow operation 101, flow of the electrolyte 24 (FIGS. 1 and 3) is reversed to flow in the direction indicated by directional arrow 86 in FIG. 3. This can be accomplished, as discussed previously herein in relation to FIG. 3, by switching the valves 74, 76, 78 and 80 such that the electrolyte 24 flows through the crossover pipes 82 and 84 of FIG. 3. Alternatively, the pump 26 of FIG. 1 could be reversed to reverse the direction of flow of the electrolyte. Still other alternatives, known or yet to be developed, could be used to reverse the direction of flow of the electrolyte 14 to accomplish the present inventive method.

Following either the normal electrolyte flow operation 98 or the reverse electrolyte flow operation 101, in an end of pipe decision operation 102 it is determined if the cathode 14 has reached the end of the pipe 28. If the cathode 14 has reached the end of the pipe 28, the in place electropolishing method 90 proceeds to an end polish operation 104 wherein the pipe electrochemical polishing system 10, 10*a* is cleaned and shut down according to prior art methods. If it is determined in the end of pipe decision operation 102 that the end of the pipe 28 has not been reached then the decision loop returns to the detect cathode position operation 94 and the process is repeated as indicated in the flow diagram of FIG.4.

Various modifications to the inventive method and apparatus are also quite possible, while remaining within the scope of the invention. For example, alternative means could be developed for determining the position of the cathode 14. Also, alternative means for reversing the flow of the electrolyte 24 in the pipe 28 could be developed. Another logical alternative would be to use the apparatus specifically disclosed herein, and/or other apparatus yet to be developed, in combinations not specifically discussed herein.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive pipe electrochemical polishing system 10, 10*a* and associated in place electropolishing method 80 are intended to be widely used for the in place polishing of the inner surfaces of piping systems. It is presently thought by the inventor that it will be useful to reverse the direction of flow of the electrolyte 14 in any section of the pipe 28 that is more than just 2 or 3 degrees off of horizontal, and further wherein the cathode 14 is traveling generally downward in such section.

Since the inventive pipe electrochemical polishing system 10, 10*a* and associated in place electropolishing method 90 may be readily produced and integrated with existing electropolishing systems, and since the advantages as described herein are provided, it is expected that it will be readily accepted in the industry. For these and other reasons, it is expected that the utility and industrial applicability of the invention will be both significant in scope and long-lasting in duration.

I claim:

1. An electropolishing apparatus for polishing the inner surface of a pipe having both horizontal portions and non-horizontal portions, the electropolishing apparatus comprising:

an electrode;

an electrolyte source for providing electrolyte flow through the pipe;

a power supply for providing power to said electrical element;

a puller for pulling said electrical element through the pipe; and a position detector for detecting the position of said electrical element; and wherein the direction of flow of the electrolyte through the pipe is reversible.

2. The electropolishing apparatus of claim 1, wherein the direction of flow of the electrolyte in the pipe is reversible by the action of operating a plurality of valves.

3. The electropolishing apparatus of claim 1, wherein the direction of flow of the electrolyte in the pipe is reversible by the action of reversing the direction of a reversible pump.

4. The electropolishing apparatus of claim 1, wherein said position detector includes a detector for detecting how much of a cable has been pulled through the pipe by the puller.

5. The electropolishing apparatus of claim 4, wherein said position detector includes a plurality of marks on the cable and a mark detector.

6. The electropolishing apparatus of claim 5, wherein the mark detector is a optical mark detector.

7. The electropolishing apparatus of claim 5, wherein the mark detector is a magnetic mark detector.

8. The electropolishing apparatus of claim 1, wherein said position detector includes a heat detector for detecting heat created by said electrical element.

9. The electropolishing apparatus of claim 8, wherein said position detector includes a heat sensing crayon mark.

10. The electropolishing apparatus of claim 8, wherein said position detector includes an infra red camera.

11. The electropolishing apparatus of claim 8, wherein said position detector includes a thermister.

12. The electropolishing apparatus of claim 1, wherein said position detector includes a capacitance measuring device for measuring the capacitance in the pipe.

13. The electropolishing apparatus of claim 1, wherein said electrode is a cathode.

14. The electropolishing apparatus of claim 1, wherein the direction of flow of the electrolyte is reversed when the electrode is traveling generally upward in the pipe.

15. The electropolishing apparatus of claim 1, further comprising a controller responsive to position signals from said position detector and operative to provide electrolyte flow direction signals to said electrolyte source.

16. A method for polishing the inner surface of a pipe having both generally horizontal sections and generally non-horizontal sections, the method comprising:

pulling an electrode through a pipe filled with an electrolyte while providing electrical power to said electrode;

keeping track of the position of said electrode within said pipe;

flowing the electrolyte in a first direction in the pipe when the electrode is traveling in a generally horizontal section of the pipe; and flowing the electrolyte in a second direction in the pipe when the electrode is traveling generally upward in a generally non-horizontal section of the pipe.

17. The method of claim 16, further comprising flowing the electrolyte in said first direction in the pipe when the electrode is traveling generally downward in a generally non-horizontal section of the pipe.

18. A computer readable medium having code embodied therein for causing an electronic device to perform the steps of claim 17.

19. The method of claim 16, wherein direction of flow of the electrolyte is controlled by a reversible pump.

20. The method of claim 16, wherein keeping track of the position of said electrode is accomplished by measuring the progress of a cable as the cable pulls said electrode through the pipe.

21. A computer readable medium having code embodied therein for causing an electronic device to perform the steps of claim 20.

22. The method of claim 20, wherein measuring the progress of the cable is accomplished by counting marks on the cable.

23. The method of claim 22, wherein the marks are visible marks.

24. The method of claim 22, wherein the marks are detectable by a magnetic sensor.

25. The method of claim 16, wherein direction of flow of the electrolyte is controlled by a plurality of valves.

26. The method of claim 16, wherein keeping track of the position of said electrode is accomplished by sensing heat from said electrode.

27. The method of claim 26, wherein sensing heat from said electrode is accomplished using an infra red camera.

28. The method of claim 26, wherein sensing heat from said electrode is accomplished using a thermister.

29. The method of claim 26, wherein sensing heat from said electrode is accomplished using a heat sensing crayon mark.

30. A computer readable medium having code embodied therein for causing an electronic device to perform the steps of claim 26.

31. The method of claim 16, wherein keeping track of the position of said electrode is accomplished by a capacitance sensor.

32. A computer readable medium having code embodied therein for causing an electronic device to perform the steps of claim 16.

* * * * *